US005224314A

United States Patent [19]

Chen

[11] Patent Number: 5,224,314

[45] Date of Patent: Jul. 6, 1993

[54] WASTED SPACER MEMBER FOR WALL ELEMENTS

[76] Inventor: Syu A. Chen, Suite 1, 11F, 95-8v Chang Ping Road Sec. 1, Taichung, Taiwan

[21] Appl. No.: 837,247

[22] Filed: Feb. 18, 1992

[51] Int. Cl.[5] ..... E04B 5/46

[52] U.S. Cl. ..... 52/308; 52/306; 52/442

[58] Field of Search ..... 52/308, 306, 442, 426, 52/428, 431, 562, 565, 387, 136, 509

[56] References Cited

U.S. PATENT DOCUMENTS

| | | | |
|---|---|---|---|
| 2,227,842 | 1/1941 | Polivka | 52/509 |
| 2,921,462 | 1/1960 | Wilson | 52/426 |
| 4,114,337 | 12/1976 | Neuhardt | 52/100 X |
| 4,698,947 | 10/1987 | McKay | 52/309.12 |
| 5,107,648 | 4/1992 | Roby | 52/309.12 |

*Primary Examiner*—Richard E. Chilcot, Jr.
*Assistant Examiner*—Beth A. Aubrey

[57] ABSTRACT

A wasted spacer member for spacing construction blocks in a wall formed therefrom, and particularly suited for glass bricks, comprising a pair of parallel cross-shaped or T-shaped positioning elements joined by a length adjustable connecting element including a pair of overlapping elongate connecting bars formed on the inner sides of respective positioning elements and extending perpendicularly therefrom. Each connecting bar has parallel inner and outer sides aligned parallel with a vertical direction, with the inner sides of each connecting bar being mutually abutting along the outer portions thereof. A set of aperture holes are formed at predetermined positions along a first connecting bar, and a cooperating pair of correspondingly spaced, protruding securing buttons are formed along a second connecting bar. The pair of securing buttons on the second connecting bar are engageable with a selected adjacent pair of aperture holes on the first connecting bar to correspondingly adjust the length of the spacer member so as to accommodate bricks of varying thickness. A pair of disc-shaped elements are formed on the outer side of each respective positioning element and are connected therewith via a frangible tapering projection.

12 Claims, 7 Drawing Sheets

WASTED SPACER MEMBER FOR WALL ELEMENTS

BACKGROUND OF THE PRESENT INVENTION

The present invention relates to a wasted spacer member for positioning block like wall elements, and for glass bricks in particular.

The construction of a glass brick wall usually involves the arrangement of a first layer of glass bricks with adjacent glass bricks being separated by a wooden spacer strip. A set of horizontal spacer strips are then disposed over the first layer adjacent to the edges thereof with mortar and a reinforcing bar applied in the space therebetween. A second layer of glass bricks is subsequently positioned over the first with successive layers applied in a similar manner.

After the mortar has dried the wooden strips are forceably removed and the exposed grooves thereby created are filled with a joint mortar.

The process of removing the wooden strips is time consuming and involves the use of handtools that can easily damage the fragile glass bricks if care is not taken.

The wasted spacer member of the present invention eliminates the need for the wooden strip by providing a spacer member that can properly position both adjacent and stacked bricks prior to the application of mortar, and remains imbedded within the wall after the mortar has hardened, obviating the need for removable strips.

The wasted spacer member of the present invention comprises a pair of cross shaped or T-shaped positioning elements attached by an adjustable connecting element. The spacer member is positioned between adjacent glass bricks in a horizontal and vertical direction with the positioning elements thereon disposed near the outer edges of the bricks and maintaining a proper spacing therebetween.

The adjustable connecting element of the spacer member can be adjusted in length to accomodate bricks of different thicknesses.

A vane element is attached to the center of each respective positioning element which abuts the outer faces of the glass bricks to properly position them in a perpendicular direction with respect to the wall.

Although wasted spacer members are known from the prior art, in particular with reference to U.S. Pat. No. 4,114,337 (Neuhart, 1978) Neuhart teaches a connecting element consisting of a sleeve slidingly engaged on either end thereof with a respective cylindrical projection formed on the inner sides of the positioning elements of the spacer member.

The pair of positioning elements and sleeve can easily become separated while in storage and must be reassembled before use. The pair of positioning elements could also easily be misaligned, with one element rotated relative to the other about the mutual perpendicular axis therebetween.

The connector element of the wasted spacer member of the present invention, however, firmly secures together the two positioning elements thereof and restricts the relative motion of the positioning elements to a translational motion along a perpendicular axis therebetween.

As the adjustable length wasted spacer member as taught by Neuhart has no fixed stops by which a predetermined length can be selected, each wasted spacer member must also be adjusted in length to accomodate the thickness of glass brick used prior to application.

Whereas, in a first embodiment of the wasted spacer member of the present invention, the connecting element thereof includes a set of equally spaced apertures on a first connecting bar of which any adjacent pair can be aligned and engaged with a pair of protruding buttons on a cooperating second connecting bar to adjust the length of the spacer member from among a set of predetermined lengths corresponding to varying thicknesses of glass bricks. Alternately, in a second embodiment of the wasted spacer member the connecting element thereof includes a set of vertically oriented apertures and an elastic protrusion on respective connecting bars, wherein each aperture can be selectively aligned and engaged with the protrusion to attain the same end.

The wasted spacer member of the present invention can be obtained in sets preadjusted for a given thickness of glass brick to facilitate their application. Of course, the spacer members can also be quickly adjusted to a selected predetermined length as required and without the need of a glass brick as a reference.

Furthermore, the adjustable length wasted spacer member as taught by Neuhart does not specify throughholes on the connecting sleeve thereof for the positioning of vertical reinforcing bars, or if present would require the sleeve to be rotated to a correct orientation prior to the application of the spacer member.

In contrast, the vertically oriented apertures on the connecting element of the second embodiment of the spacer member of the present invention serve also as guide holes for a vertical reinforcing bar. As the connecting element is restricted to translational motion in an axial direction, no separate alignment of the guide holes are necessary.

Differences also exist between the vane elements provided on the spacer member of the present invention and the vane elements of the spacer member as taught by Neuhart, wherein the vane elements are forceably removed by hand tools which risk damage to the glass bricks or are separately manufactured and releasably secured.

The vane element of the spacer member of the present invention can be removed by a simple manual twisting operation and is manufactured integrally along with the attached positioning element, simplifying assembly and eliminating the risk of premature separation.

SUMMARY OF THE PRESENT INVENTION

The wasted spacer member of the present invention has as a main objective to provide a wasted spacer member for positioning glass bricks or similar construction blocks with an appropriate spacing therebetween prior to securing by the application of mortar that can accommodate glass bricks of different thicknesses, and has a secondary objective of providing a wasted spacer member including a pair of vane elements for positioning glass bricks even with the surface of the wall that are readily removable without the need of hand tools and are integrally manufactured along with the main body of the wasted spacer member.

The wasted spacer member of the present invention comprises a pair of parallel cross shaped or T-shaped positioning elements secured together by a variable length connecting element.

Each cross shaped positioning element has a pair of aligned vertical arms and a pair of aligned horizontal arms formed thereon.

A wasted spacer member with T-shaped positioning elements is used mainly with glass bricks that are positioned along a border of a wall. The T-shaped positioning elements are identical with the cross-shaped positioning elements with the exception of a missing arm. The elongate flat side of the T-shaped positioning elements spaces peripheral glass bricks from a boundary partition such as a floor or ceiling.

The length of the variable length connecting element can be adjusted from among a set of predetermined lengths. Accordingly, the spacing between the parallel connecting elements can be adjusted to accomodate glass bricks of varying thicknesses.

In use, the wasted spacer members are positioned between adjacent glass blocks of a first layer. The lower vertical arm of each positioning element abuts the opposing lateral sides of adjacent glass bricks and the horizontal arms thereof abut the upper sides of the adjacent glass bricks.

Mortar is then applied over the first layer of glass bricks along with a reinforcing rod disposed in a medial position between the positioning elements of the spacer members. The variable length connecting elements are displaced below the centerlines of the spacer members, being secured on either end to a respective lower vertical arm, so as not to obstruct the reinforcing bar.

A second layer of glass bricks are then positioned over the first, with the upper vertical arms of the positioning elements abutting adjacent lateral sides of the glass bricks thereof.

In a similar fashion, wasted spacer members are positioned over the top of the second layer in preparation for a succeeding layer, and so on.

A pair of disc shaped vane elements are secured to the centers of the outer sides of respective positioning elements. The distance between the inner sides of a pair of vane elements is equal with the thickness of the glass bricks so that the outer faces of the glass bricks abut the inner sides of the vane elements. The glass bricks are thus also properly positioned in a perpendicular direction with respect to the wall, preventing the formation of an uneven wall with protruding or recessed bricks.

A twisting bar is formed on the outer faces of the disc shaped vane elements to facilitate the rotation thereof, whereupon the tapered projection shears off at the juncture thereof with the outer side of the positioning element.

After the removal of the vane elements, which can take place after the mortar has only slightly hardened, the grooves on the outer faces of the glass brick wall are filled with joint mortar as is done regardless of the spacing method, with the wasted spacer members imbedded and hidden within.

A detailed description of the form, materials, and manufacture of the preferred embodiments of the wasted spacer member of the present invention and variations thereof are provided below along with accompanying drawings.

A BRIEF DESCRIPTION OF THE DRAWINGS

PREFERRED EMBODIMENTS OF THE PRESENT INVENTION

Figure 1:
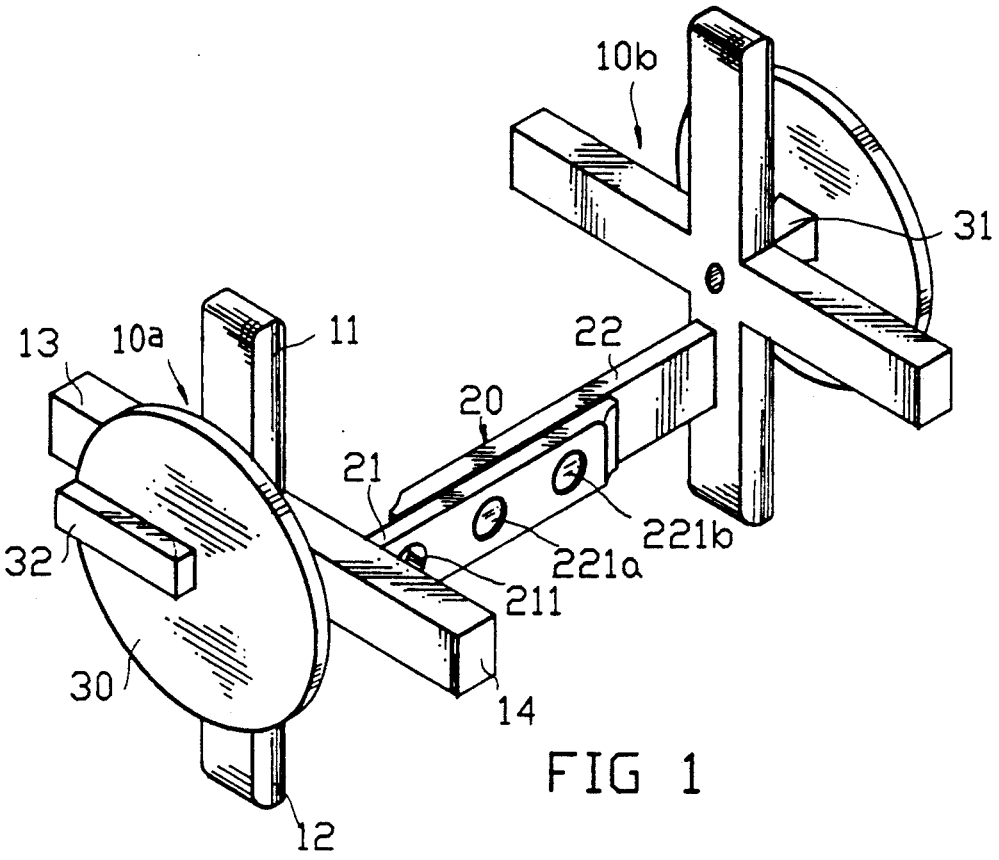
FIG. 1 is a perspective view of a first embodiment of the wasted spacer element of the present invention.

Referring to FIG. 1, a first embodiment of the wasted spacer member of the present invention comprises a pair of parallel cross shaped positioning elements 10*a* and 10*b*, and a connecting element 20 disposed therebetween including an elongate connecting bar, 21 and 22, extending perpendicularly from the inner side of respective positioning elements, 10*a* and 10*b*.

Each cross shaped positioning element includes a pair of aligned vertical arms 11 and 12, and a pair of aligned horizontal arms 13 and 14.

A wasted spacer member with a pair of T-shaped positioning elements, is also provided for properly spacing peripheral glass bricks along a boundary of the glass brick wall or glass bricks on adjacent staggered layers.

Connecting element 20 is displaced below the centers of respective positioning elements 10*a* and 10*b* to allow passage of a horizontal reinforcing bar, and comprises elongate connecting bars 21 and 22 extending perpendicularly from the inner sides of respective positioning elements 10*a*, 10*b*.

Both connecting bars 21 and 22 have parallel outer and inner sides aligned parallel with a vertical direction, with the inner side of connecting bar 21 abutting the inner side of connecting bar 22 along the respective outer portions thereof.

A set of three circular apertures 211 are formed at predetermined positions along connecting bar 21, with each aperture 211 extending from the outer side to the inner side thereof.

A pair of round, protruding securing buttons 221*a*, 221*b* with a diameter substantially equal with that of apertures 211 and having equal spacings are formed at predetermined positions on the inner side of connecting bar 22. Securing buttons 221*a*, 221*b* are inserted into a selected adjacent pair of apertures 211 forming a friction fit therein to adjust the length of the spacer member.

Figure 2:
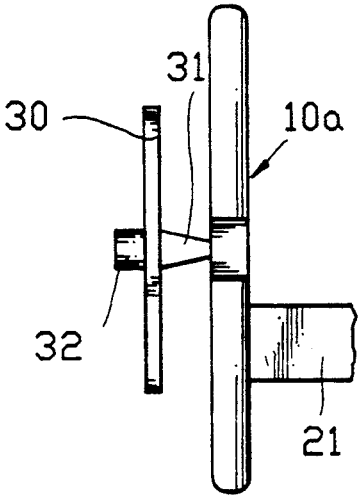
FIG. 2 is a perspective view of the molded wasted spacer member prior to separation and assembly.

Referring also to FIG. 2, a disc shaped vane element 30 is formed on the outer side of each positioning element, 10*a* , and 10*b*. An elongate and tapering securing projection 31 with square cross-sections is formed on the center of the inner side of vane element 30, with the narrow end thereof adjoining with the center of the outer side of a respective positioning element, 10*a* or 10*b*.

An elongate twisting bar 32 is formed on the outer side of vane element 30, across a radius thereof, enabling a user to manually rotate vane element 30, whereby securing projection 31 twists and shears off from a positioning element 10*a* and 10*b* at the juncture therebetween.

The shape, dimensions, and specificaties of manufacture of vane element 30 have all been predetermined to provide vane element 30 with sufficient lateral rigidity and resistance to tension relative to positioning element 10*a* or 10*b* adjoined therewith, while facilitating its removal therefrom by hand torque without the aid of other instruments.

After the wasted spacer member of the present invention has been adjusted to a selected predetermined length appropriate for glass bricks of a given thickness, the distance between the parallel inner sides of respective disc shaped vane elements 30 thereof is substantially equal with the thickness of the glass brick.

Figure 3:
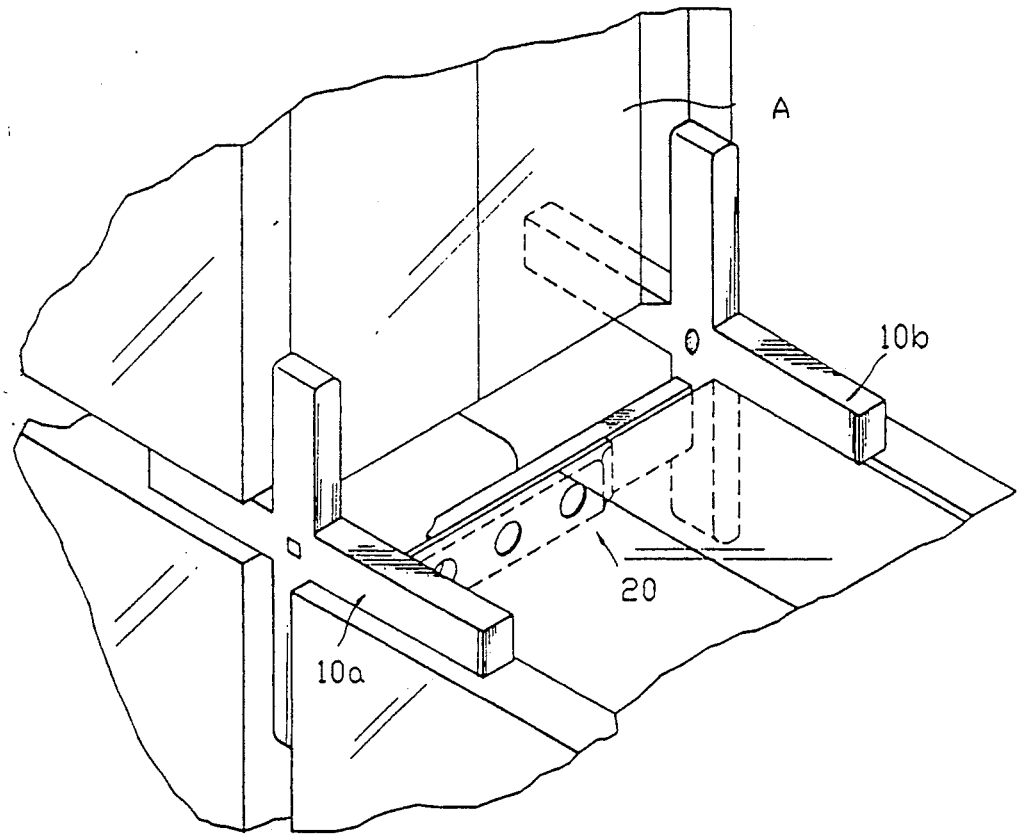
FIG. 3 is a side view of the wasted spacer member showing a vane element thereof attached to a positioning element.

As shown in FIG. 3, a wasted spacer member of the present invention is shown positioning glass bricks A with a proper spacing therebetween in both horizontal and vertical directions with the vane elements 30 thereof having been removed, which is usually performed after applied mortar has hardened.

Figure 4:
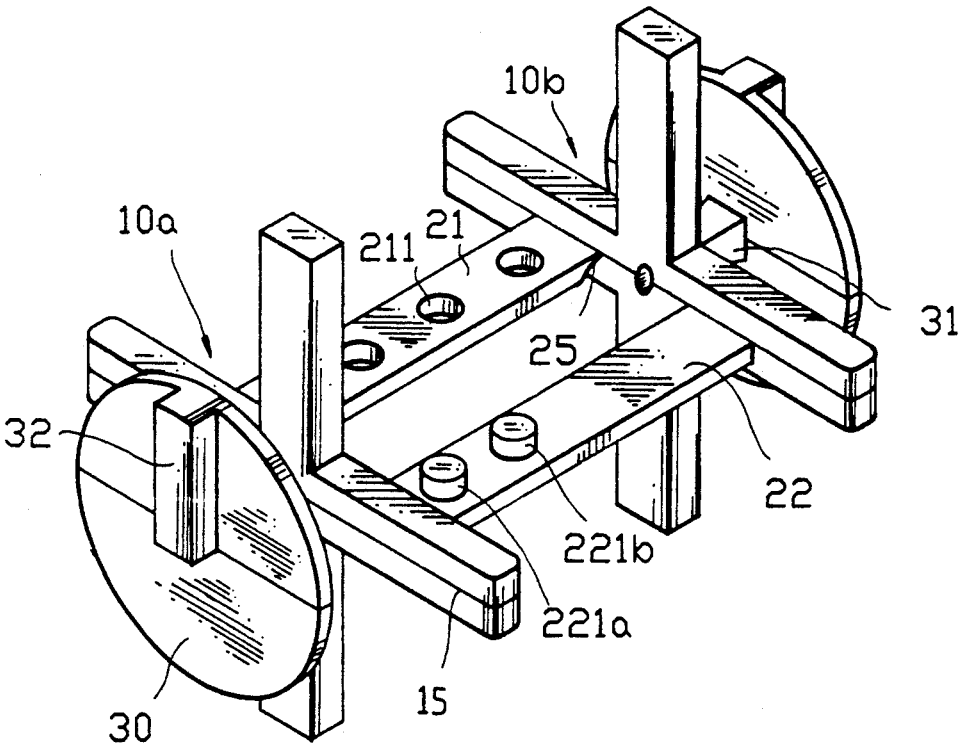
FIG. 4 is a perspective view of the wasted spacer member positioning a set of glass bricks with mortar applied therebetween and the vane elements removed.

The first embodiment of a wasted spacer member can be rapidly and inexpensively manufactured by injection molding as a single integral unit using a simple two part mold. As shown in FIG. 4, the parting line 15 of the molded spacer member passes around the vane elements 30 and positioning elements 10*a*, 10*b* indicating the separation of the two mold halves with connecting bars 21 and 22 adjoining with respective positioning elements 10*b*, 10*a* via a beveled taper section 25. The connecting bars could thus be readily separated from their respective positioning elements with a simple snap action by a user prior to assembly and application. As such there are no parts which could be separated and lost during transport or storage.

Figure 5:
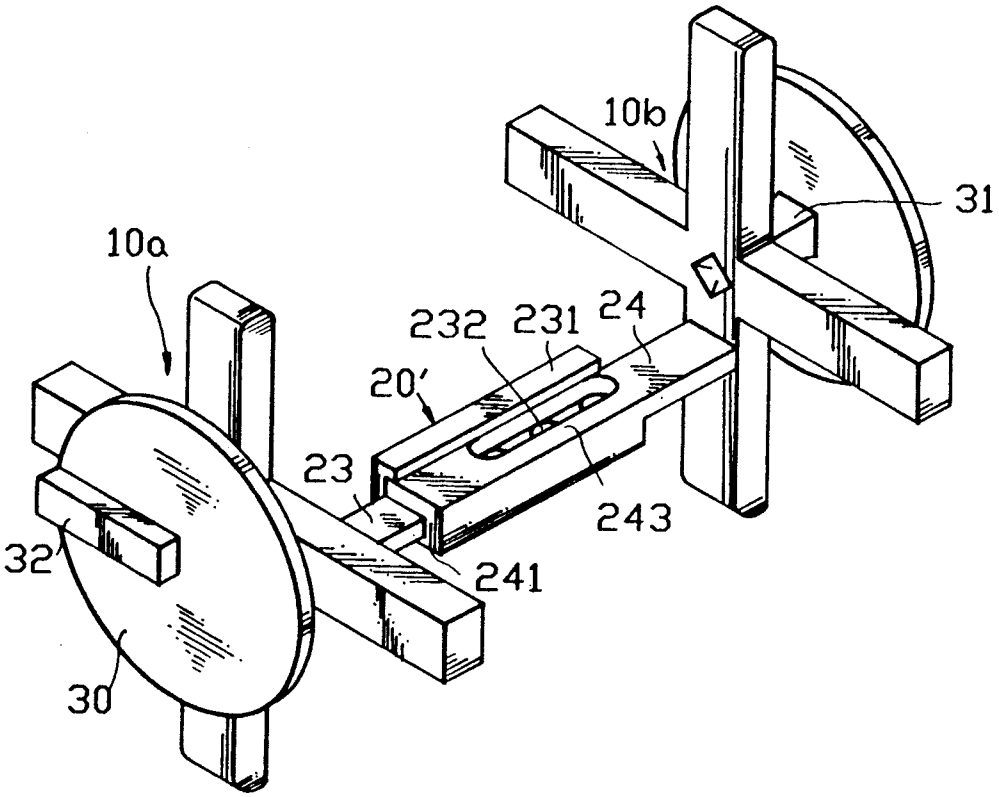
FIG. 5 is a perspective view of a second embodiment of the wasted spacer element of the present invention.

Referring to FIG. 5, a second embodiment of the wasted spacer member of the present invention differs from the first only in structure of the connecting element 20' thereof, wherein both connecting bars 23 and 24 have parallel upper and lower sides perpendicularly aligned with a vertical direction, with the upper side of connecting bar 23 abutting the lower side of connecting bar 24 along the respective outer portions thereof.

An overturned rim 231 formed on the outer portion of connecting bar 23 along the left edge thereof defines a guide groove abutting a substantial portion of the left edge and upper side of connecting bar 24.

A similar overturned rim 241 formed on the outer portion of connecting bar 22 along the right edge thereof defines a guide groove abutting a substantial portion of the right edge and lower side of connecting bar 23.

Connecting bars 23 and 24 are thus slidingly engaged and are restricted to a translational motion along an axial direction.

A set of circular apertures 232 are formed along the outer portion of connector bar 23 at predetermined positions thereon, with each aperture 232 extending from the upper side of connecting bar 23 to the lower side thereof aligned with a vertical direction.

A shallow lenticular protrusion 242 is formed on the lower side of connector bar 24 near the outer end thereof at a predetermined position.

Figure 6:
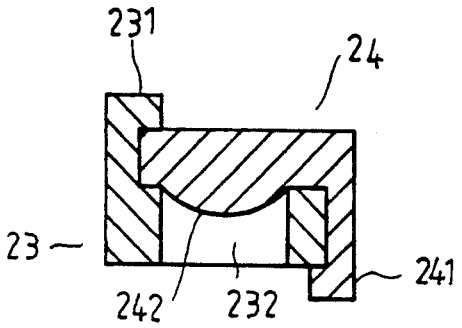
FIG. 6 is a cross-sectional view taken along line 1—1 of FIG. 5, showing a section of a connecting element of the wasted spacer member.

As shown in FIG. 6, protrusion 242 abuts the rim of a first circular aperture 232, in closest proximity to positioning element 10*a*, to releasably secure positioning element 10*a* and connecting bar 23 to positioning element 10*b* and connecting bar 24, with the spacer member assuming a corresponding predetermined length.

Connector bar 24 has sufficient elasticity to enable shallow protrusion 242 to rise above the surface of the upper side of connecting bar 23 when connector bar 24 is slided relative thereto.

Protrusion 242 can be engaged with a selected aperture 232 so as to adjust the spacer member to a corresponding length, with each selected predetermined length corresponding with the thickness of a commonly available type glass brick.

An elongate oval shaped slot 243 of predetermined dimensions is formed along the outer portion of connector bar 24 between protrusion 242 and adjoining positioning element 10*b*.

Slot 243 has a width substantially equal with the diameters of circular apertures 232, and a length of sufficient extent such that slot 243 communicates with and does not overlap the aperture 232 in closest proximity to the outer end of connecting bar 23 when protrusion 242 engages the aperture 232 thereon in closest proximity to positioning element 10*a*.

As such, each aperture 232 is in full communication with the exterior space above and below connecting element 20', with the exception of the corresponding aperture 232 engaged with protrusion 242 at a selected length setting.

Figure 7:
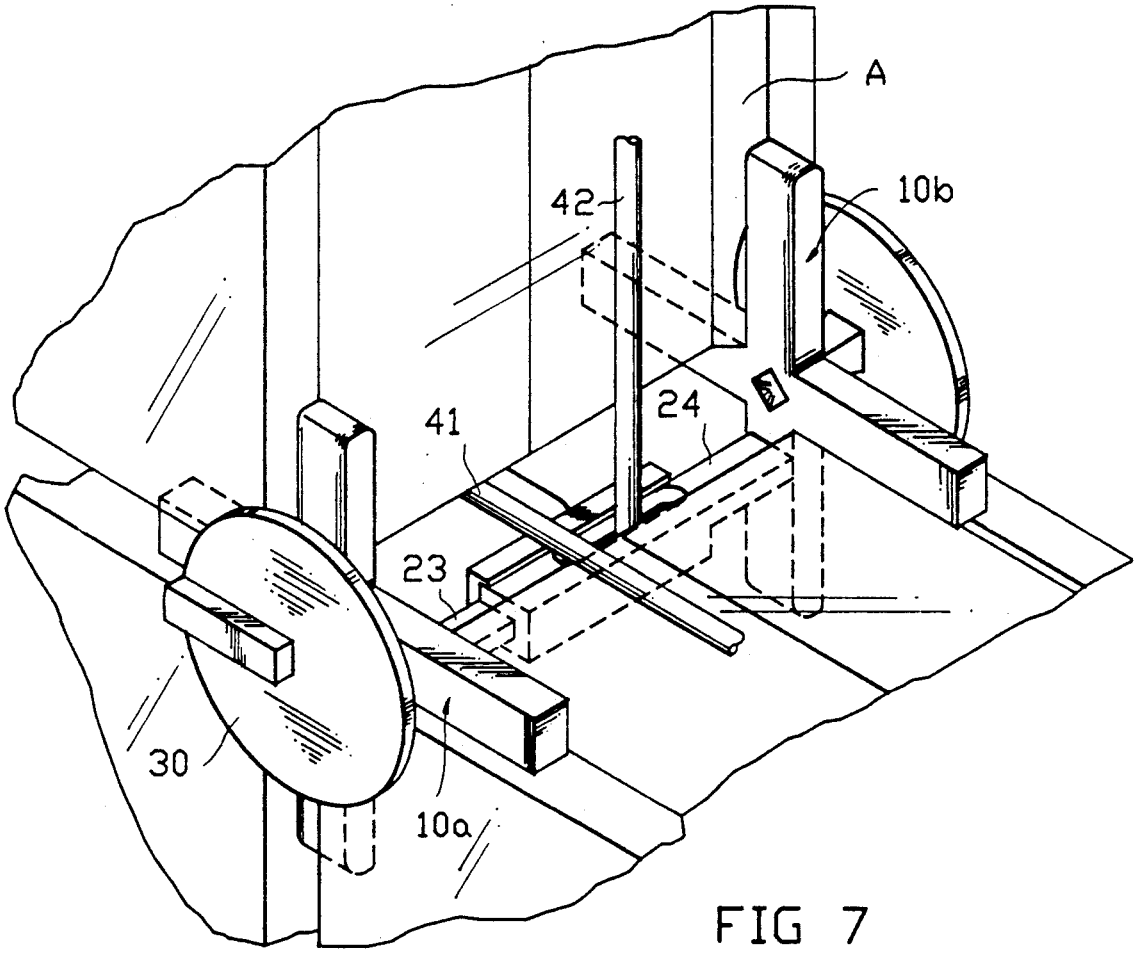
FIG. 7 is a perspective view of the wasted spacer member positioning a set of glass bricks with a horizontal and vertical reinforcing bar in place.

Thus in addition to the placement of a horizontal reinforcing bar 41 as is possible with the first embodiment, a vertical reinforcing bar 42 can also be passed through an aperture 232, or through slot 243 and an aperture 232, as shown in FIG. 7.

As with the first embodiment, the wasted spacer member can be economically manufactured by injection molding and preferably from a non-hygroscopic synthetic material, as any expansion from the absorption of moisture from the surrounding mortar would be detrimental to accurate positioning of the bricks.

Figure 8:
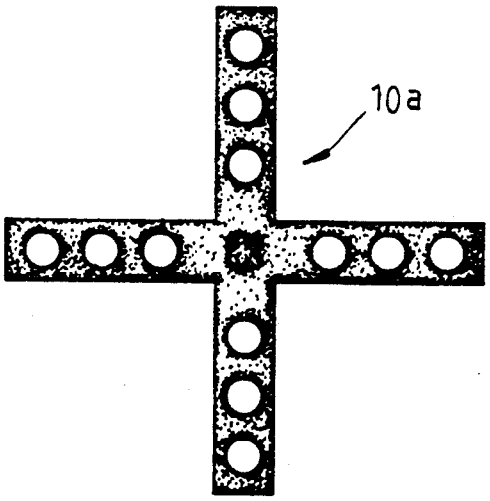
FIG. 8 is an end-on view showing a positioning element of the spacer member having apertures formed on the arms thereof.

Further, as shown in FIG. 8 material saving apertures can be formed on the arms of positioning elements 10*a*, 10*b* which also serve to present more bearing surfaces to the mortar, increasing the cohesion of the mass. The spacer member can also be formed with rough outer surfaces for a similar purpose.

Other variations and modifications to the present invention would also be readily apparent to a person of average skill in the art, and as such the spirit and scope of the present invention should not be determined by the specificities of the above description but from the appended claims and their legal equivalents.

I claim:

1. A wasted spacer element for spacing adjacent lateral surfaces and adjacent upper and lower surfaces of juxtaposed construction blocks in a wall formed therefrom comprising:

a pair of parallel generally crossed shaped or T shaped positioning elements providing vertical and horizontal arms;

a length adjustable connecting element disposed between said positioning elements, including first and second elongate connecting bars located on each of said positioning element and extending perpendicularly therefrom, said first and second connecting bars each having a parallel inner side and outer side being aligned parallel with a vertical direction;

a set of equally spaced apertures formed at predetermined positions along said first connecting bar in an axial direction; and a cooperating pair of protruding securing buttons formed along said second connecting bar, having a spacing and diameters substantially equal with the spacing between adjacent apertures and the diameters thereof, respectively;

wherein, said second connecting bar can be releasably secured to said first connecting bar by inserting said pair of securing buttons into a selected pair of adjacent said apertures so as to correspondingly adjust the length of said spacer member from among a set of predetermined lengths.

2. A wasted spacer member according to claim 1, wherein said connecting element is adjacent to each respective positioning element at positions offset from the centers thereof.

3. A wasted spacer member according to claim 2, wherein a vane element provided on the outer side of each respective said positioning element comprises:

a generally disk shaped member with an elongate and radially disposed twisting bar formed on the outer side thereof; and a tapering protrusion with square cross sections, the broad end thereof being adjoined to the inner side of said disc shaped member and the narrow end thereof adjoined to the center of the outer side of a respective said positioning element;

whereby, said vane element can be detached from said spacer member by rotating said twisting bar until said tapering projection shears off from said positioning element at the area of juncture therebetween.

4. A wasted spacer member according to claim 3, wherein said spacer member is manufactured by injection molding.

5. A wasted spacer member according to claim 4, wherein said spacer member is manufactured as an integral unit with said first connector bar and said second connector bar each having a beveled taper portion which is adjoined with a respective opposing said positioning element, so that said first connector bar and said second connector bar can be readily separated from respective opposing said positioning elements at said taper portions therebetween.

6. A wasted spacer member according to claim 5, wherein said spacer member is provided with outer surfaces of rough texture and said arms of said positioning members are provided with apertures formed thereon to effect greater cohesion with the mortar of said wall.

7. A wasted spacer member according to claim 6, wherein said spacer member is manufactured from a non hygroscopic synthetic material.

8. A wasted spacer element for spacing adjacent lateral surfaces and adjacent upper and lower surfaces of juxtaposed construction blocks in a wall formed therefrom comprising:

a pair of parallel generally crossed shaped or T shaped positioning elements providing vertical and horizontal arms;

a length adjustable connecting element disposed between said positioning elements, including a first and second elongate connecting bars provided on respective said positioning elements and extending perpendicularly therefrom, said first and second connecting bars each having a parallel upper side and lower side being aligned perpendicularly with a vertical direction;

a set of vertically aligned circular apertures formed along said first connecting bar in an axial direction at predetermined positions thereon;

a lenticular shaped protrusion formed on said lower side of said second connecting bar, at a predetermined position thereon with a diameter substantially equal with the diameter of said circular apertures;

an elongate oval shaped slot of predetermined dimensions formed on said second connecting bar between said protrusion and said positioning element adjoined therewith, being aligned in an axial direction;

a first overturned rim formed along an adjoining edge of said upper side of said first connecting bar, said first rim abutting a substantial portion of said upper face of said second connecting bar and an adjoining edge thereof; and a second overturned rim formed along an adjoining edge of said lower side of said second connecting bar, said second rim abutting a substantial portion of said lower face of said first connecting bar and an adjoining edge thereof;

wherein, said first and second connecting bars are slidingly engaged and restricted to translational motion along an axial direction, and said first connecting bar can be slided relative to said second connecting bar to snap fit said protrusion over a selected said aperture to adjust the length of said spacer member from among a set of predetermined lengths, and a vertical reinforcing rod can be inserted through said vertically aligned apertures of said connecting element.

9. A wasted spacer member according to claim 8, wherein said connecting element is adjacent with respective positioning elements at positions offset from the centers thereof.

10. A wasted spacer member according to claim 9, wherein a vane element provided on the outer side of each respective said positioning element comprises:

a generally disk shaped member with an elongate and radially disposed twisting bar formed on the outer side thereof; and a tapering protrusion with square cross sections, the broad end thereof being adjoined to the inner side of said disc shaped member and the narrow end thereof adjoined to the center of the outer side of a respective said positioning element;

whereby, said vane element can be detached from said spacer member by rotating said twisting bar until said tapering projection shears off from said positioning element at the area of juncture therebetween.

11. A wasted spacer member according to claim 10, wherein said spacer member is provided with outer surfaces of rough texture and said arms of said positioning members are provided with apertures formed thereon to effect greater cohesion with the mortar of said wall.

12. A wasted spacer member according to claim 11, wherein said spacer member is manufactured by injection molding from a non hygroscopic synthetic material.

* * * * *